US008662294B2

(12) United States Patent
Benbassat

(10) Patent No.: US 8,662,294 B2
(45) Date of Patent: Mar. 4, 2014

(54) MULTI-FLAVOR FLAVORING SYSTEM

(76) Inventor: Zack Benbassat, Orlando, FL (US)

( * ) Notice: Subject to any disclaimer, the term of this patent is extended or adjusted under 35 U.S.C. 154(b) by 356 days.

(21) Appl. No.: 12/945,502

(22) Filed: Nov. 12, 2010

(65) Prior Publication Data

US 2011/0059208 A1 Mar. 10, 2011

Related U.S. Application Data

(63) Continuation of application No. 11/753,683, filed on May 25, 2007, now abandoned.

(51) Int. Cl.
*B65D 81/32* (2006.01)

(52) U.S. Cl.
USPC ..... 206/222; 215/227

(58) Field of Classification Search
USPC ..... 206/219, 222; 215/227, 229
See application file for complete search history.

(56) References Cited

U.S. PATENT DOCUMENTS

| | | | | |
|---|---|---|---|---|
| 2,824,010 | A * | 2/1958 | Pedersen | 426/120 |
| 5,255,812 | A * | 10/1993 | Hsu | 220/277 |
| 6,098,795 | A * | 8/2000 | Mollstam et al. | 206/222 |
| 6,105,760 | A * | 8/2000 | Mollstam et al. | 206/222 |
| 8,522,968 | B2 * | 9/2013 | Middleman et al. | 206/222 |
| 2002/0066680 | A1 * | 6/2002 | Stern et al. | 206/222 |
| 2002/0179461 | A1 * | 12/2002 | Mollstam et al. | 206/222 |
| 2006/0124526 | A1 * | 6/2006 | Flick | 210/222 |
| 2007/0211563 | A1 * | 9/2007 | De Vries | 366/139 |
| 2010/0000887 | A1 * | 1/2010 | Troesch et al. | 206/219 |
| 2011/0174642 | A1 * | 7/2011 | Coon | 206/222 |

* cited by examiner

*Primary Examiner* — Jacob K Ackun
(74) *Attorney, Agent, or Firm* — McKinney Law, PLLC

(57) ABSTRACT

A multi-flavor flavoring system is disclosed. The system includes a flexible substrate having a first surface adapted to be secured to a beverage bottle and at least one flavor packet secured to a second surface of the substrate. The flavor packet of the system includes a cylinder and a plunger within the cylinder. The system may include a radial flange about an interior surface of the cylinder and an annular groove about a periphery of the plunger. The annular groove is adapted to engage the radial flange to bias the plunger in a first position. Whereupon user movement of the plunger permits the groove to move past the flange to bias the plunger in a second position within the cylinder to pierce the side wall of the beverage bottle to allow flavoring liquid of the flavor packet to be in fluid communication with contents of the beverage bottle.

8 Claims, 6 Drawing Sheets

MULTI-FLAVOR FLAVORING SYSTEM

I. CROSS-REFERENCE TO RELATED APPLICATIONS

This application is a continuation of application Ser. No. 11/753,683, filed May 25, 2007 now abandoned.

II. FIELD

The present disclosure is generally related to flavored beverages, and more specifically to a multi-flavor flavoring system for a beverage bottle that allows a consumer to select a flavor for the beverage prior to consumption.

III. DESCRIPTION OF RELATED ART

Supermarkets and convenience stores advertise and sell various flavors of beverages. For example, orange, lemon, grape and cherry flavored beverages may occupy shelf space. However, it is desirable for a single generic unflavored beverage to have the ability of being flavored by the consumer after purchase. Accordingly, a store can supply a shelf with one type of unflavored beverage to save shelf space from unwanted products and meet demand and increase revenue.

There have been attempts to improve containers to allow flavor to be added by the user. By way of example, note U.S. Pat. No. 5,310,564 to Kimm, that discloses a beverage container having internal flavoring tubes. The tubes have perforations so that when selective pressure is applied from outside of the container the flavoring is released into the container. A shortcoming of this prior art is that it is a costly and complex process to manufacture the flavoring tubes within a container.

Another example is U.S. Pat. No. 7,017,735 to Carlson that discloses a beverage container cap that contains liquid flavoring. However, Carlson is not adaptable to contain several different flavors for selection by a consumer.

Notwithstanding the existence of such prior art beverage containers, there is a need for an improved multi-flavor flavoring system and method that is capable of multi flavors and is adaptable to retrofit existing containers and/or manufacturing equipment so that it is inexpensive and relatively simple to implement.

It is, therefore, to the effective resolution of the aforementioned problems and shortcomings of the prior art that the present invention is directed.

However, in view of the prior art at the time the present invention was made, it was not obvious to those of ordinary skill in the pertinent art how the identified needs could be fulfilled.

IV. SUMMARY

In a particular embodiment, a multi-flavor flavoring system for a beverage bottle is disclosed. The system includes a flexible substrate having a first surface adapted to be secured to a beverage bottle and at least one flavor packet secured to a second surface of the substrate. The flavor packet of the system also includes a cylinder, a plunger within the cylinder biased in a first position, whereupon user movement of the plunger permits the plunger to move from the first position to a second position within the cylinder, and a piercing point secured to the plunger is adapted to pierce a side wall of the beverage bottle when the plunger is moved to the second position.

In addition, the system may include a radial flange about an interior surface of the cylinder, and an annular groove about a periphery of the plunger, where the annular groove is adapted to engage the radial flange to bias the plunger in the first position, whereupon user movement of the plunger permits the groove to move past the flange to bias the plunger in the second position within the cylinder to pierce the side wall of the beverage bottle. Alternatively, the system may include cylinder threads about an interior surface of the cylinder, and plunger threads about a periphery of the plunger, where the plunger threads are adapted to engage the cylinder threads to bias the plunger in the first position. Whereupon user rotational movement of the plunger permits the plunger to move to the second position within the cylinder to pierce the side wall of the beverage bottle.

Further, the system may include flavoring liquid contained within the at least one flavor packet, where the flavoring liquid is adapted to be in fluid communication with contents of the beverage bottle upon piercing the side wall of the beverage bottle with the piercing point. Each flavor packet of the at least one flavor packet contains a different type of flavoring liquid identified by a corresponding different color.

The flexible substrate of the system is adapted to be configured into a ring to fit snugly around a beverage bottle. An adhesive layer on the first surface of the substrate may be used to form a water-tight seal between the at least one flavor packet and the side wall of the beverage bottle so that when the side wall is pierced no liquid leaks from between the at least one flavor packets and the bottle.

The at least one flavor packet may transparent so that a user can identify a type of flavoring liquid by a corresponding color. The flavoring liquid of the at least one flavor packet may be at a higher pressure than contents of the bottle to facilitate disbursement of the flavoring liquid into the bottle upon piercing the side wall of the bottle.

In another particular embodiment, a multi-flavor flavoring method for a beverage bottle is disclosed. The method includes providing a flexible substrate having a first surface adapted to secure the substrate to a beverage bottle, securing at least one flavor packet to a second surface of the substrate, providing the at least one flavor packet with a plunger within a cylinder that is biased in a first position, whereupon user movement of the plunger permits the plunger to move from the first position to a second position within the cylinder, and securing a piercing point to the plunger and adapted to pierce a side wall of the beverage bottle when the plunger is moved to the second position.

The method may also include providing a radial flange about an interior surface of the cylinder, and providing an annular groove about a periphery of the plunger, where the annular groove is adapted to engage the radial flange to bias the plunger in the first position, whereupon user movement of the plunger permits the groove to move past the flange to bias the plunger in the second position within the cylinder to pierce the side wall of the beverage bottle. Alternatively, the method may include providing cylinder threads about an interior surface of the cylinder, and providing plunger threads about a periphery of the plunger, where the plunger threads are adapted to engage the cylinder threads to bias the plunger in the first position, whereupon user rotational movement of the plunger permits the plunger to move to the second position within the cylinder to pierce the side wall of the beverage bottle.

Further, the method may include providing flavoring liquid within the at least one flavor packet, where the flavoring liquid is adapted to be in fluid communication with contents of the beverage bottle upon piercing the side wall of the beverage bottle with the piercing point. A different type of flavoring liquid packet may be provided to each of the at least one flavor packet and identified by a corresponding different color.

The flexible substrate of the method may be formed into a ring to fit snugly around a beverage bottle. An adhesive layer may be provided on the first surface of the flexible substrate, where the adhesive is adapted to form a water-tight seal between the at least one flavor packet and the side wall of the beverage bottle so that when the side wall is pierced no liquid leaks from between the at least one flavor packets and the bottle.

Other aspects, advantages, and features of the present disclosure will become apparent after review of the entire application, including the following sections: Brief Description of the Drawings, Detailed Description, and the Claims.

V. BRIEF DESCRIPTION OF THE DRAWINGS

VI. DETAILED DESCRIPTION

A particular advantage provided by the embodiments of the multi-flavor favoring system and method is the ability to manufacture the system separately from the beverage bottle. The system is not integrated to the bottle but can be used with any plastic type bottle. Accordingly, the system can be used with any existing beverage bottle without affecting the existing manufacturing process of the bottle. Further, the system can be sold separately to consumers and easily applied. The system can be sold in a ring configuration to slide over a beverage bottle. Alternatively, the system can be sold in strips or in a roll with perforations allowing a consumer to form the correct length of the system to apply to any beverage bottle of any diameter.

Figure 3:
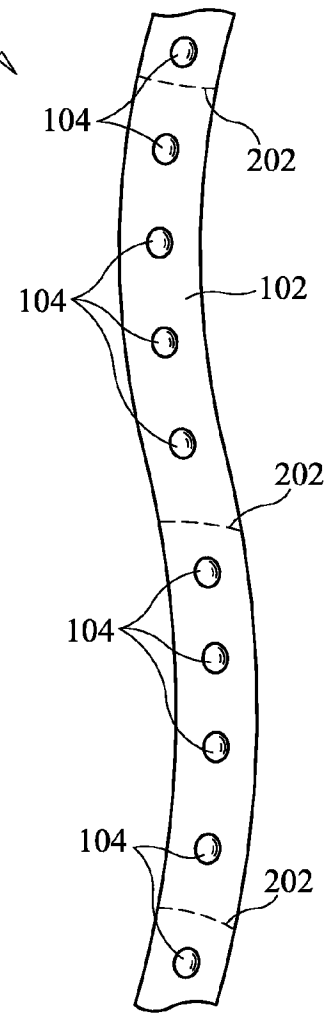
FIG. 3 is a front view of another illustrative embodiment of the multi-flavor flavoring system in a linear embodiment having perforations.
Figure 2:
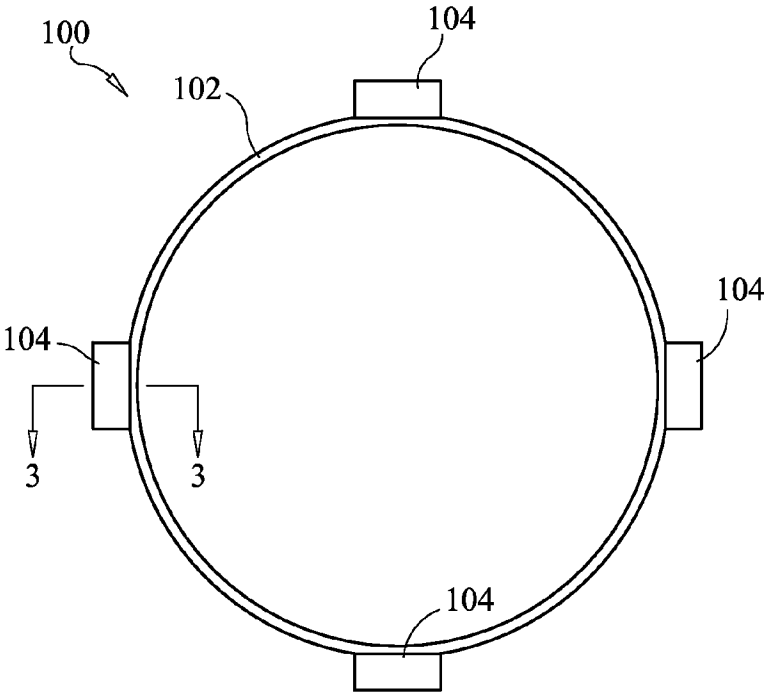
FIG. 2 is a top view of a particular illustrative embodiment of the multi-flavor flavoring system shown in FIG. 1.
Figure 1:
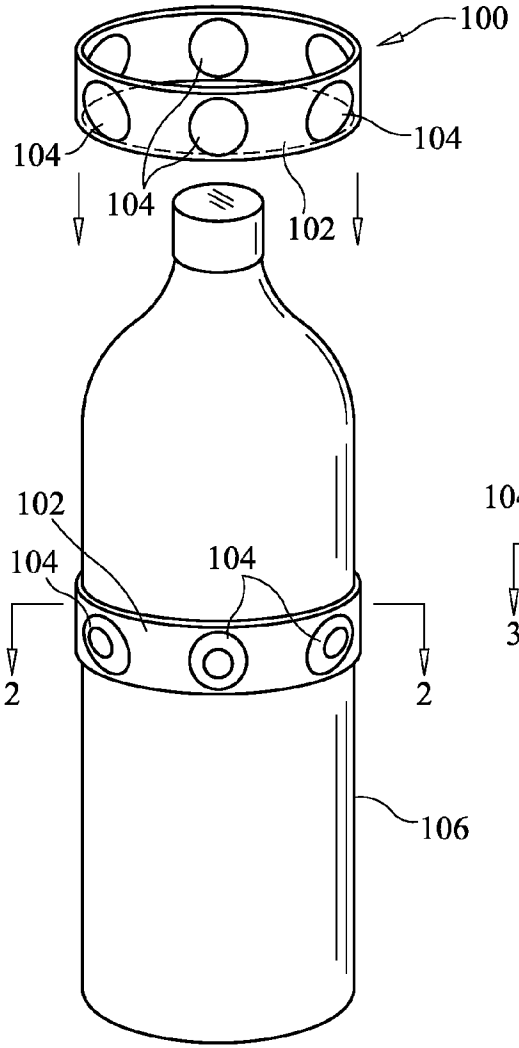
FIG. 1 is a perspective view of a particular illustrative embodiment of a multi-flavor flavoring system installed on a beverage bottle.

Referring now to FIG. 1, multi-flavor flavoring system is disclosed and generally designated 100. A flexible substrate 102 includes a first surface adapted to be secured to a beverage bottle 106. At least one flavor packet 104 is secured to a second surface of the substrate 102. As shown in FIG. 1, the system 100 is formed into a ring and adapted to fit snugly around the beverage bottle 106. The size of the ring (i.e., the diameter) helps to form a water-tight seal between the system 100 and the bottle 106. Further, an adhesive layer on a second surface of the substrate 102 may be used to secure the system 100 to the bottle. The system 100 may also be heat shrink wrapped to the bottle 106. FIG. 2 illustrates that in a particular configuration of the system 100 that there are four flavor packets 104 spaced around the substrate 102, although any number can be used depending on the size of the substrate 102 and flavor packets 104. In an alternative embodiment illustrated in FIG. 3, the substrate 102 is linear and having perforations 202 to enable a user to tear the substrate 102 to a desired length. The substrate 102 may also be cut to any desired length. The flavor packets 104 are spaced evenly on the substrate 102.

Figure 5:
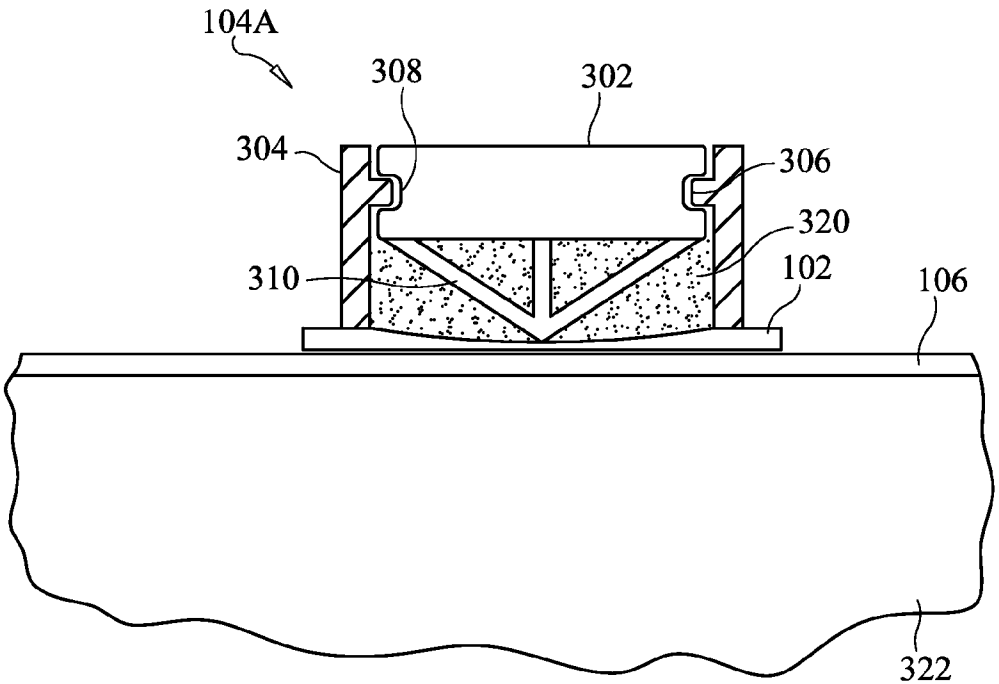
FIG. 5 is a cross sectional view of the flavor packet shown in FIG. 4 in a first position installed on a bottle.
Figure 4:
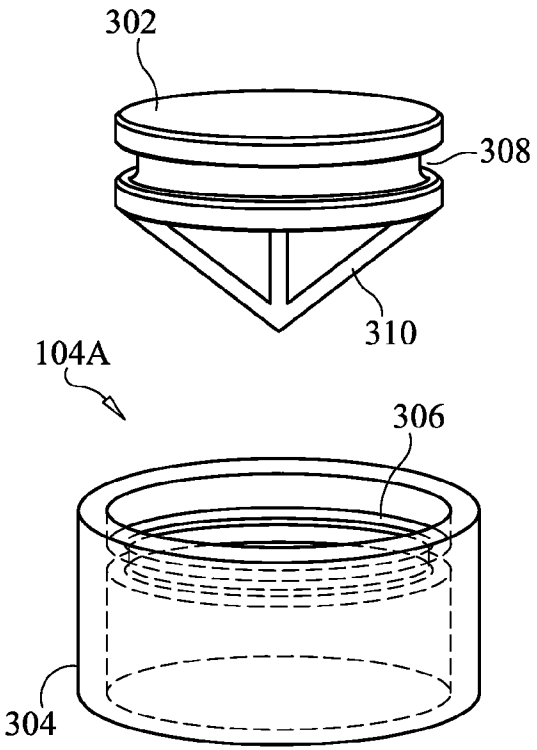
FIG. 4 is an exploded view of a particular illustrative embodiment of a flavor packet of the system.
Figure 6:
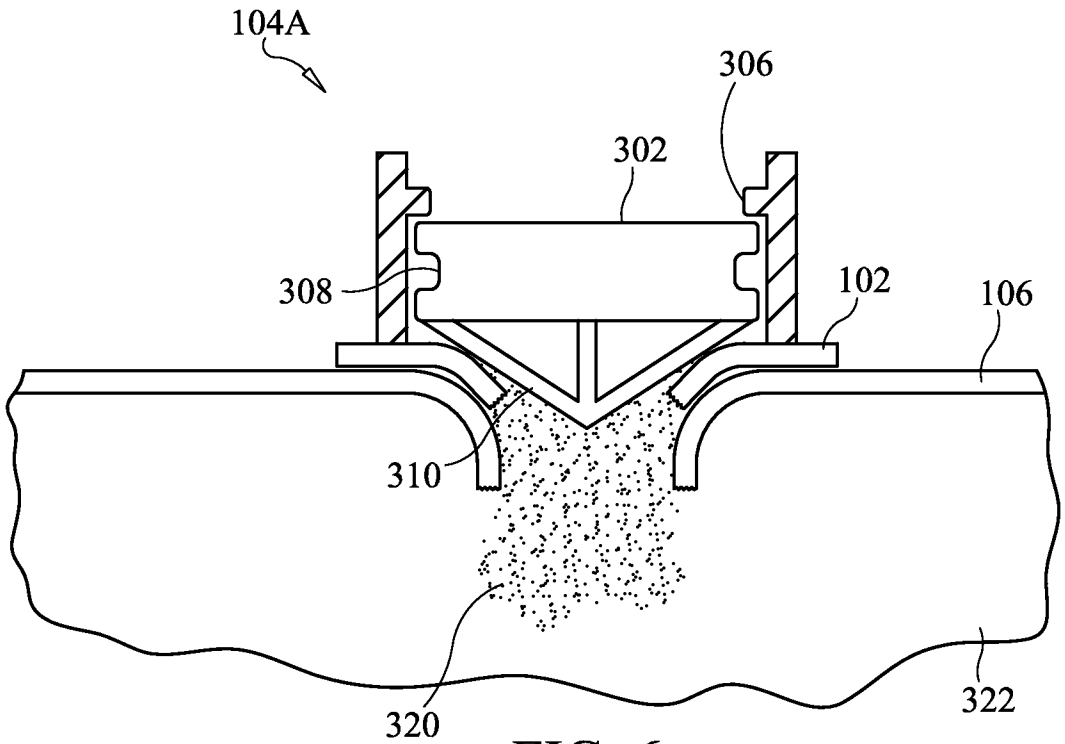
FIG. 6 is a cross sectional view of the flavor packet shown in FIGS. 4-5 in a second position piercing a side wall of the bottle.

One embodiment of the flavor packets 104 of the system 100 is shown in FIGS. 4-6 and generally designated 104A. FIG. 4 is an exploded view of the flavor packet 104A. The flavor packet 104A may include a cylinder 304 and a plunger 302 adapted to slide within the cylinder 304. The plunger 302 may also include a piercing point 310. Referring now to FIG. 5, the plunger 302 is biased in a first position, whereupon user movement of the plunger 302 permits the plunger 302 to move from the first position to a second position within the cylinder 304 as shown in FIG. 6. Flavoring liquid 310 is stored in the flavoring packet 104A. The piercing point 310 is secured to the plunger 302 and adapted to pierce a side wall of the beverage bottle 106 when the plunger 302 is moved to the second position. The flavor packet 104A may include a radial flange 306 about an interior surface of the cylinder 304, and an annular groove 308 about a periphery of the plunger 302, where the annular groove 308 is adapted to engage the radial flange 306 to bias the plunger 302 in the first position, whereupon user movement of the plunger 302 permits the groove 308 to move past the flange 306 to bias the plunger 302 in the second position within the cylinder 304 to pierce the substrate 102 and side wall of the beverage bottle 106 as illustrated in FIG. 6. This releases the flavoring liquid 320 into the contents 322 of the bottle 106.

Figure 8:
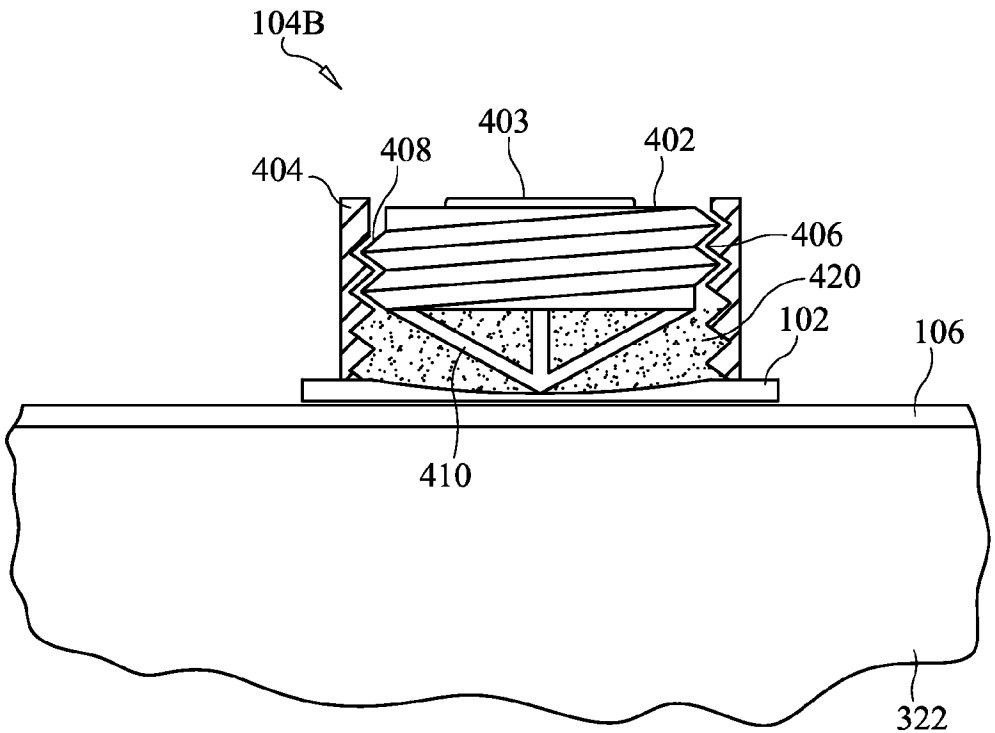
FIG. 8 is a cross sectional view of the flavor packet shown in FIG. 7 in a first position installed on a bottle.
Figure 7:
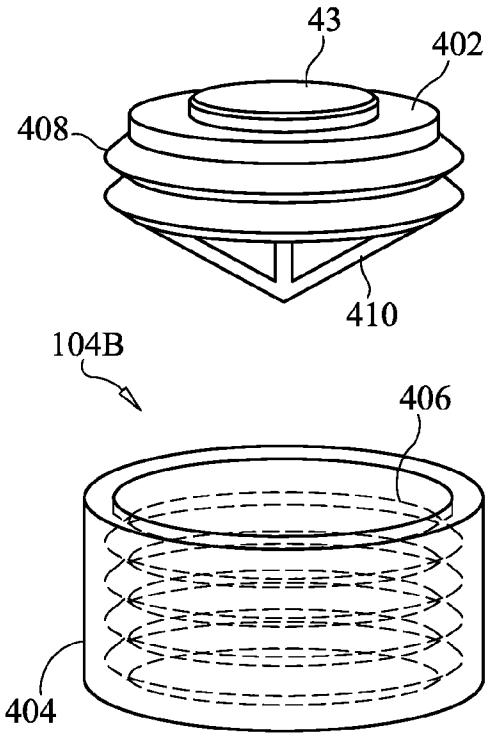
FIG. 7 is an exploded view of another particular illustrative embodiment of a flavor packet of the system.
Figure 9:
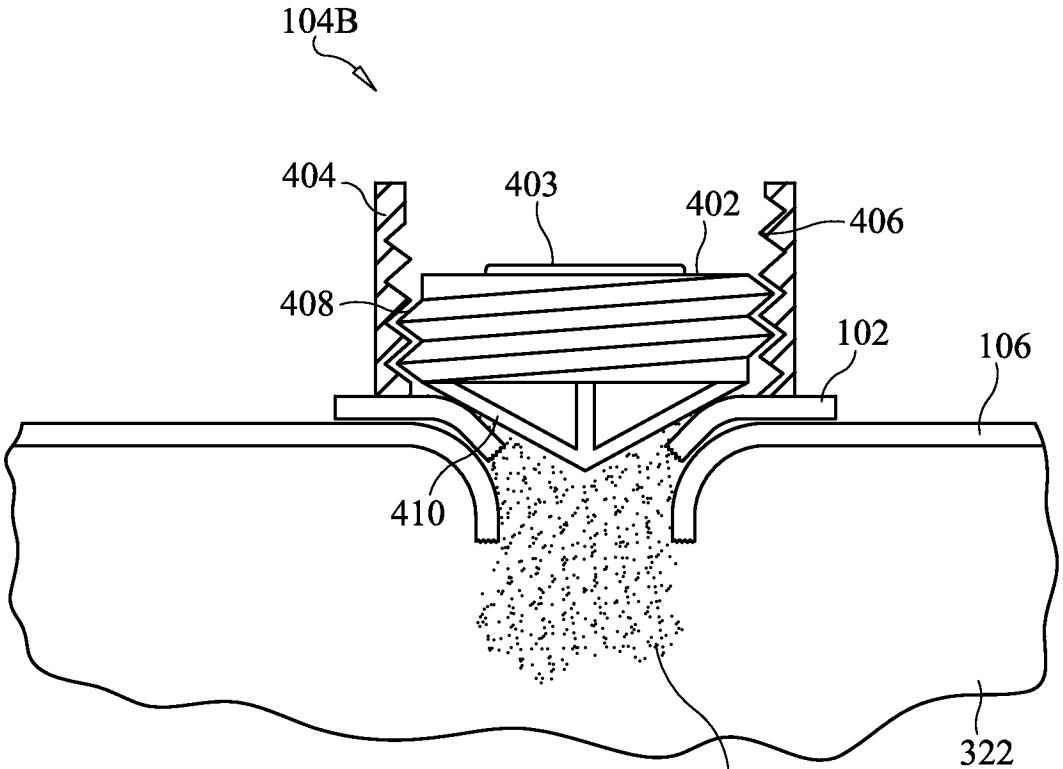
FIG. 9 is a cross sectional view of the flavor packet shown in FIGS. 7-8 in a second position piercing a side wall of the bottle; and FIG. 10

Another embodiment of the flavor packets 104 of the system 100 is shown in FIGS. 7-9 and generally designated 104B. FIG. 7 is an exploded view of the flavor packet 104B. In this embodiment of the flavor packet 104B, the cylinder 404 may include cylinder threads 406 about an interior surface of the cylinder 404, and plunger threads 408 about a periphery of the plunger 402, where the plunger threads 408 are adapted to engage the cylinder threads 406 to bias the plunger 402 in the first position. Whereupon user rotational movement of the plunger 402 permits the plunger 402 to move to the second position within the cylinder 404 to pierce the side wall of the beverage bottle 106. A tab 403 of the plunger 402 may be used to help the user rotate the plunger 402. Referring now to FIG. 8, the plunger 402 is biased in a first position, whereupon user rotational movement of the plunger 402 permits the plunger 402 to move from the first position to a second position within the cylinder 404 using the threading as shown in FIG. 8. Flavoring liquid 410 is stored in the flavoring packet 104B. The piercing point 410 is secured to the plunger 402 and adapted to pierce a side wall of the beverage bottle 106 when the plunger 402 is moved to the second position.

Referring now to FIG. 9, user rotational movement of the plunger 402 permits the plunger 402 to rotate and move towards the bottle 106 using the cylinder threads to bias the plunger 402 in the second position within the cylinder 404 to pierce the substrate 102 and side wall of the beverage bottle 106 as illustrated in FIG. 9. This releases the flavoring liquid 320 into the contents 322 of the bottle 106. Each flavor packet 104 of the system 100 may contain a different type of flavoring liquid 320 identified by a corresponding different color.

The flexible substrate 102 of the system 100 is adapted to be configured into a ring to fit snugly around a beverage bottle 106. An adhesive layer on the first surface of the substrate 102 may be used to form a water-tight seal between the at least one flavor packet 104 and the side wall of the beverage bottle 106 so that when the side wall is pierced no liquid leaks from between the at least one flavor packets 104 and the bottle 106.

The flavor packet 104 may be transparent so that a user can identify a type of flavoring liquid 320 by a corresponding color. The flavoring liquid 320 of the flavor packet 104 may be at a higher pressure than contents 322 of the bottle 106 to facilitate disbursement of the flavoring liquid 320 into the bottle 106 upon piercing the side wall of the bottle 106.

Figure 10:
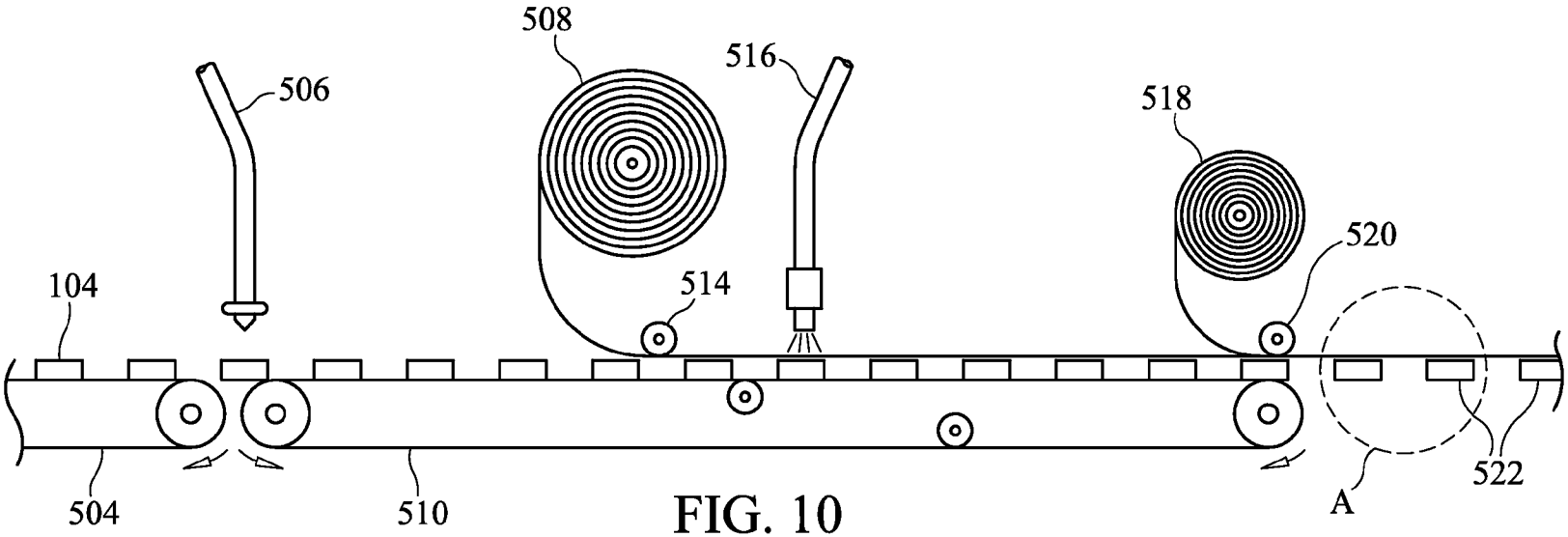
Figure 11:
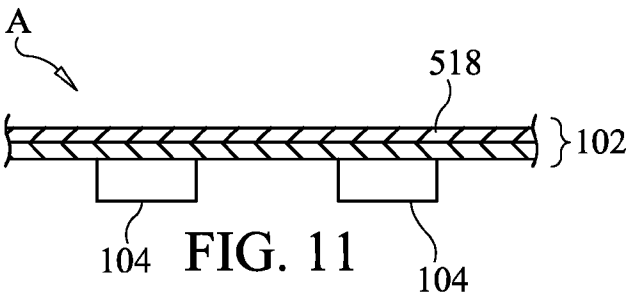
FIG. 11 is a particular illustrative embodiment of a method of manufacturing the system illustrated in FIGS. 1-9.

Referring now to FIG. 10, a method of manufacturing the system is disclosed. For example, a flavor packet 104 is provided using a first conveyor, at 504. The flavor packet 104 is filled with flavoring liquid, at 506. A substrate 508 is provided to seal the flavor packet 104, at 514. Application of heat or UV rays is used to further seal the flavor packet, at 516. A conveyor 510 continues to move the sealed flavor packets 104 to another station, at 520, where an adhesive layer 518 may be applied to a first surface of the substrate 508, to form the system illustrated in FIG. 11. The system 100 can now be formed into a ring and adapted to fit snugly around the beverage bottle 106. As explained above, an adhesive layer 518 on a second surface of the substrate 508 may be used to secure the system to the bottle. The system 100 may also be heat shrink wrapped to the bottle 106.

A multi-flavor flavoring method for a beverage bottle is disclosed. The method includes providing a flexible substrate 102 having a first surface adapted to secure the substrate 102 to a beverage bottle 106, securing at least one flavor packet 104 to a second surface of the substrate 102, providing the at least one flavor packet 104 with a plunger 302, 402 within a cylinder 304, 404 that is biased in a first position, whereupon user movement of the plunger 302, 402 permits the plunger 302, 402 to move from the first position to a second position within the cylinder 304, 404, and securing a piercing point 310 to the plunger 302, 402 and adapted to pierce a side wall of the beverage bottle 106 when the plunger 302, 402 is moved to the second position.

The method may also include providing a radial flange 306 about an interior surface of the cylinder 304, and providing an annular groove 308 about a periphery of the plunger 302, where the annular groove 308 is adapted to engage the radial flange 306 to bias the plunger 302 in the first position, whereupon user movement of the plunger 302 permits the groove 308 to move past the flange 306 to bias the plunger 302 in the second position within the cylinder 304 to pierce the side wall of the beverage bottle 106. Alternatively, the method may include providing cylinder threads 406 about an interior surface of the cylinder 404, and providing plunger threads 408 about a periphery of the plunger 402, where the plunger threads 408 are adapted to engage the cylinder threads 406 to bias the plunger 402 in the first position, whereupon user rotational movement of the plunger 402 permits the plunger 402 to move to the second position within the cylinder 404 to pierce the side wall of the beverage bottle 106.

Further, the method may include providing flavoring liquid 320 within the at least one flavor packet 104, where the flavoring liquid 320 is adapted to be in fluid communication with contents 322 of the beverage bottle 106 upon piercing the side wall of the beverage bottle 106 with the piercing point 310. A different type of flavoring liquid 320, 420 may be provided to each flavor packet 104 and identified by a corresponding different color.

The flexible substrate 102 of the method may be formed into a ring to fit snugly around a beverage bottle 106. An adhesive layer 518 may be provided on the first surface of the flexible substrate 102, where the adhesive 518 is adapted to form a water-tight seal between the at least one flavor packet 104 and the side wall of the beverage bottle 106 so that when the side wall is pierced no liquid leaks from between the flavor packets 104 and the bottle 106.

The previous description of the disclosed embodiments is provided to enable any person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. A multi-flavor flavoring system, the system comprising:

a flexible substrate having a first surface configured into a ring to fit around a beverage bottle;

at least one flavor packet secured to a second surface of the substrate, wherein the at least one flavor packet further comprising:

a cylinder;

a plunger within the cylinder biased in a first position, whereupon user movement of the plunger permits the plunger to move from the first position to a second position within the cylinder; and a piercing point secured to the plunger and adapted to pierce a side wall of the beverage bottle when the plunger is moved to the second position.

2. The system of claim 1, further comprising:

a radial flange about an interior surface of the cylinder; and an annular groove about a periphery of the plunger, wherein the annular groove is adapted to engage the radial flange to bias the plunger in the first position, whereupon user movement of the plunger permits the groove to move past the flange to bias the plunger in the second position within the cylinder to pierce the side wall of the beverage bottle.

3. The system of claim 1, further comprising:

cylinder threads about an interior surface of the cylinder; and plunger threads about a periphery of the plunger, wherein the plunger threads are adapted to engage the cylinder threads to bias the plunger in the first position, whereupon user rotational movement of the plunger permits the plunger to move to the second position within the cylinder to pierce the side wall of the beverage bottle.

4. The system of claim 1, further comprising flavoring liquid contained within the at least one flavor packet, wherein the flavoring liquid is adapted to be in fluid communication with contents of the beverage bottle upon piercing the side wall of the beverage bottle with the piercing point.

5. The system of claim 4, wherein each flavor packet of the at least one flavor packet contains a different type of flavoring liquid identified by a corresponding different color.

6. The system of claim 1, wherein the flexible substrate includes an adhesive layer on the first surface and the adhesive adapted to form a water-tight seal between the at least one flavor packet and the side wall of the beverage bottle so that when the side wall is pierced no liquid leaks from between the at least one flavor packets and the bottle.

7. The system of claim 1, wherein the at least one flavor packet is transparent so that a user can identify a type of flavoring liquid by a corresponding color.

8. The system of claim 4, wherein the flavoring liquid of the at least one flavor packet is at a higher pressure than atmospheric pressure to facilitate disbursement of the flavoring liquid into the bottle upon piercing the side wall of the bottle.

* * * * *